US006003701A

United States Patent [19]

Hidding et al.

[11] Patent Number: 6,003,701

[45] Date of Patent: Dec. 21, 1999

[54] TAMPER RESISTANT BOTTLE CAP AND NECK

[76] Inventors: Walter E. Hidding, Rte. 7-367A Woodrock Rd.; Douglas J. Hidding, 412 Caesar Dr., both of Barrington Hills, Ill. 60010; Robert D. Hidding, 38W191 Binnie Lake Trail, West Dundee, Ill. 60118

[21] Appl. No.: 09/018,620

[22] Filed: Feb. 4, 1998

[51] Int. Cl.[6] ..... B65D 41/34

[52] U.S. Cl. ..... 215/252; 215/44

[58] Field of Search ..... 215/252, 256, 215/258, 330, 43–45

[56] References Cited

U.S. PATENT DOCUMENTS

| | | | |
|---|---|---|---|
| 3,232,470 | 2/1966 | Gibson . | |
| 3,527,372 | 9/1970 | Manning . | |
| 3,901,404 | 8/1975 | Feldman . | |
| 3,980,195 | 9/1976 | Fillmore | 215/256 |
| 4,062,466 | 12/1977 | Conti | 215/252 |
| 4,098,419 | 7/1978 | Virog, Jr. et al. . | |
| 4,131,212 | 12/1978 | Rumball . | |
| 4,153,174 | 5/1979 | Keeler . | |
| 4,197,960 | 4/1980 | Walter | 215/252 |
| 4,326,639 | 4/1982 | Stahl et al. | 215/252 |
| 4,337,870 | 7/1982 | Keeler | 215/252 |
| 4,436,212 | 3/1984 | Alejandro Llera | 215/252 |
| 4,498,597 | 2/1985 | Bashour . | |
| 4,566,603 | 1/1986 | Moore . | |
| 4,573,599 | 3/1986 | Fillmore . | |
| 4,687,114 | 8/1987 | Crisci . | |
| 4,771,904 | 9/1988 | Perne et al. | 215/252 |
| 4,790,448 | 12/1988 | Ostrum et al. . | |
| 4,815,620 | 3/1989 | Bullock, III | 215/256 |
| 4,922,684 | 5/1990 | Nelson . | |
| 5,092,478 | 3/1992 | La Pierre | 215/256 |
| 5,213,224 | 5/1993 | Luch . | |
| 5,307,945 | 5/1994 | Hidding et al. . | |
| 5,385,252 | 1/1995 | Hidding et al. . | |
| 5,480,045 | 1/1996 | Molinaro et al. | 215/256 |
| 5,593,055 | 1/1997 | Repp et al. | 215/256 |
| 5,642,825 | 7/1997 | Wohlgemuth | 215/256 |

*Primary Examiner*—Nathan Newhouse
*Attorney, Agent, or Firm*—Baker & McKenzie

[57] ABSTRACT

A tamper resistant bottle cap and neck for a threaded blow molded bottles which hold liquid, such as milk. The bottle cap and neck combination has an enhanced tamper evidency feature wherein a circumferential lip is formed at the outside edge of the interface between the cap and the neck. The lip protects the contents of the bottle by limiting the ability of potential tamperers to pry or bend upwardly the rachet ring at lower edge of the cap.

35 Claims, 4 Drawing Sheets

TAMPER RESISTANT BOTTLE CAP AND NECK

BACKGROUND AND SUMMARY OF THE INVENTION

1. Field of the Invention

This invention relates to closure devices, and in particular, relates to an injection molded tamper resistant bottle cap and neck for bottles which hold liquids, such as milk or juice.

2. Description of the Related Art

Injection molded caps for blow molded bottles have been used for many years. Generally, two types of bottle caps are available, push-on caps and thread-on caps. Push-on caps are installed by aligning the cap with the opening of a bottle and simply applying an axial force to the top of the cap. Thread-on caps generally require that the cap and bottle be aligned and that a rotative force be applied to the cap. In some cases, threaded caps, if carefully designed in conjunction with the bottle to which it is applied, can be made so that the rotative force required to install the cap is minimized or even eliminated. These kinds of injection molded caps are often made with low density polypropylene, a common material used in injection molding.

One of the problems associated with injection molded caps relates to the tamper-evident connection which must be created between the bottle cap and bottle. One method of forming a tamper-evident connection is to use a threaded bottle cap which includes a ratchet ring having internal ratchet teeth in combination with a bottle neck having external ratchet teeth. When the bottle cap is screwed on the bottle neck, the ratchet teeth of the bottle cap ride over the mating ratchet teeth on the bottle neck, thereby enabling the bottle cap to be fully tightened on the bottle neck. However, when a user attempts to unscrew the bottle cap using low-to-medium twisting force, the ratchet teeth of the bottle cap positively engage the mating ratchet teeth of the bottle neck, thereby preventing unthreading and unsealing of the cap. When higher levels of twisting force are applied to the bottle cap in the direction of unscrewing, the ratchet ring breaks away from the bottle cap and the bottle cap may be unscrewed from the bottle neck. In this manner, removal of the ratchet ring from the bottle cap serves as visual evidence that the bottle has been opened.

While the combination of a bottle cap with a tamper evidencing ring and a bottle neck with ratchet teeth provides for an acceptable tamper-evident connection, this combination does have its limitations. Specifically, it may be possible for a person to pull the lower edge of the ratchet ring outward and then upward toward the cover of the bottle cap in order to defeat the locking action of the ratchet teeth of the bottle cap and bottle neck. It would then be possible to unscrew the bottle cap without breaking the ratchet ring away from the bottle cap and to screw the bottle cap back on the bottle neck. If this were to occur, there may be little visual evidence that the cap has been unscrewed and subsequently screwed back on the bottle neck. Therefore, present tamper-evident connections between a bottle cap and bottle neck may not provide optimum tamper resistance in certain circumstances.

For the foregoing reasons, there is a need for an improved tamper resistant bottle cap and bottle neck which further limit the ability of a person to tamper with the contents of a bottle. Specifically, there is a need for a tamper resistant bottle cap and bottle neck which limit the ability of a person to pry a tamper evidencing ring with ratchet teeth away from the mating ratchet teeth on a bottle neck, unscrew the cap from the bottle neck, and subsequently screw the cap back on the bottle neck.

It is therefore a primary object of the present invention to provide an improved tamper resistant bottle cap and bottle neck for use in bottles which hold liquids, such as milk and juice.

It is a further object of the present invention to provide an improved tamper resistant seal between a bottle cap and a bottle neck.

It is another object of the present invention to provide a tamper-evident threaded bottle cap with an improved ratchet ring which limits the ability of a person to pull the lower edge of the ratchet ring outward and then upward toward the cover of the bottle cap in an effort to defeat the locking action of the ratchet teeth of the bottle cap and the ratchet teeth of the bottle neck.

It is yet another object of the present invention to provide a bottle neck with an improved circumferential ring which makes it is very difficult to insert an object under the outer lower corner of a ratchet ring of a bottle cap and pry the ratchet ring of the bottle cap away from the bottle neck in an effort to defeat the locking action of the ratchet teeth of the bottle cap and the ratchet teeth of the bottle neck.

SUMMARY OF THE INVENTION

The present invention is directed to a tamper resistant bottle cap and bottle neck that satisfy the need for a bottle closure with an improved tamper resistant seal. A bottle closure having the features of the present invention broadly comprises a bottle cap and a bottle neck.

The bottle cap of the present invention includes a circular cover, a skirt depending from the periphery of the cover, and a tamper evidencing ring. The skirt of the bottle cap includes an interior surface having threads for retaining the cap to a bottle neck and a lower end having a circumferential flange with semi-circular outwardly extending tabs. The tamper evidencing ring of the bottle cap includes a plurality of ratchet teeth which are capable of meshing with a matching set of ratchet teeth on a bottle neck. The tamper evidencing ring is connected to the flange by frangible connections between the outwardly extending tabs of the flange and the ratchet teeth of the tamper evidencing ring. Each of the frangible connections is generally defined by an area of overlap between a lower surface of each tab and an upper surface of each of the ratchet teeth of the tamper evidencing ring.

The use of tabs connected to ratchet teeth as a means for attaching the tamper evidencing ring to the skirt of the cap provides for a bottle cap that limits the ability of a person to pull the lower edge of the ratchet ring outward and upward toward the cover of the cap as the strong connections between the tabs and ratchet teeth resist twisting. Therefore, the design of the bottle cap of the present invention, wherein the attachment of the skirt and the tamper evidencing ring of the bottle cap is made by way of a connection between tabs and the ratchet teeth of the tamper evidencing ring, provides for a bottle cap having increased tamper resistance.

The bottle neck of the present invention includes an opening at its upper end, a cylindrical exterior surface having threads for retaining a bottle cap, a circumferential ratchet portion below the threads, and a circumferential transfer ring below the ratchet portion. The ratchet portion includes ratchet teeth which are capable of meshing with a matching set of ratchet teeth on a bottle cap. The circumferential transfer ring includes an annular top surface and an upwardly extending circumferential ridge on the periphery of the annular top surface.

The threads of the bottle cap and the bottle neck of the present invention are appropriately dimensioned so as to sealingly engage when the bottle cap is screwed onto the bottle neck. After the bottle cap has been screwed onto the bottle neck, a lower edge of the tamper evidencing ring is located adjacent the top surface of the transfer ring and the ratchet teeth of the bottle neck and the ratchet teeth of the bottle cap are engaged so as to prevent unscrewing of the bottle cap relative to the bottle neck without breaking the frangible connections. The location of the lower edge of the tamper evidencing ring adjacent the top surface of the transfer ring provides additional tamper resistance to the combination of the bottle cap and bottle neck of the present invention. Specifically, when the bottle cap is fully threaded onto bottle neck, the ridge of the transfer ring completely surrounds the lower portion of the ratchet ring so that it is very difficult to insert a thin object, such as a fingernail, under the outer lower corner of the ratchet ring. Therefore, it is difficult to insert an object under the ratchet ring and pry the ratchet ring away from the bottle neck in an effort to defeat the locking action of the ratchet teeth of the ratchet ring and the ratchet teeth of the bottle neck.

BRIEF DESCRIPTION OF THE DRAWINGS

These and other features, aspects, objects, and advantages of the present invention will be become better understood upon consideration of the following detailed description, appended claims and accompanying drawings where:

Figure 1:
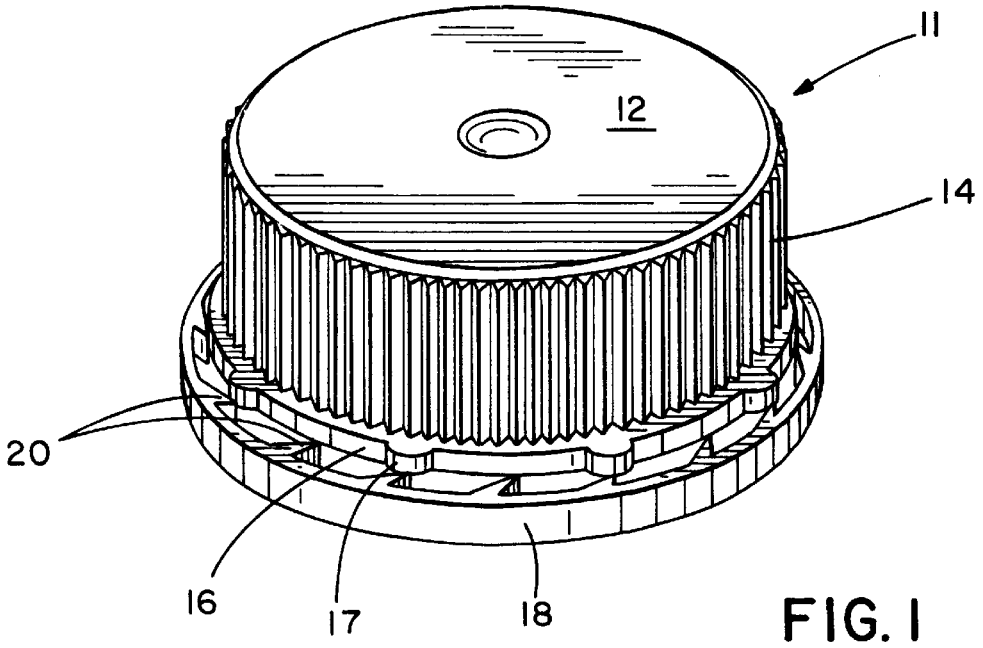
FIG. 1 is a perspective view of a bottle cap made in accordance with the present invention.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

Like reference numerals will be used to refer to like or similar parts from Figure to Figure in the following description of the drawings.

Description of the Preferred Embodiments

Figure 2:
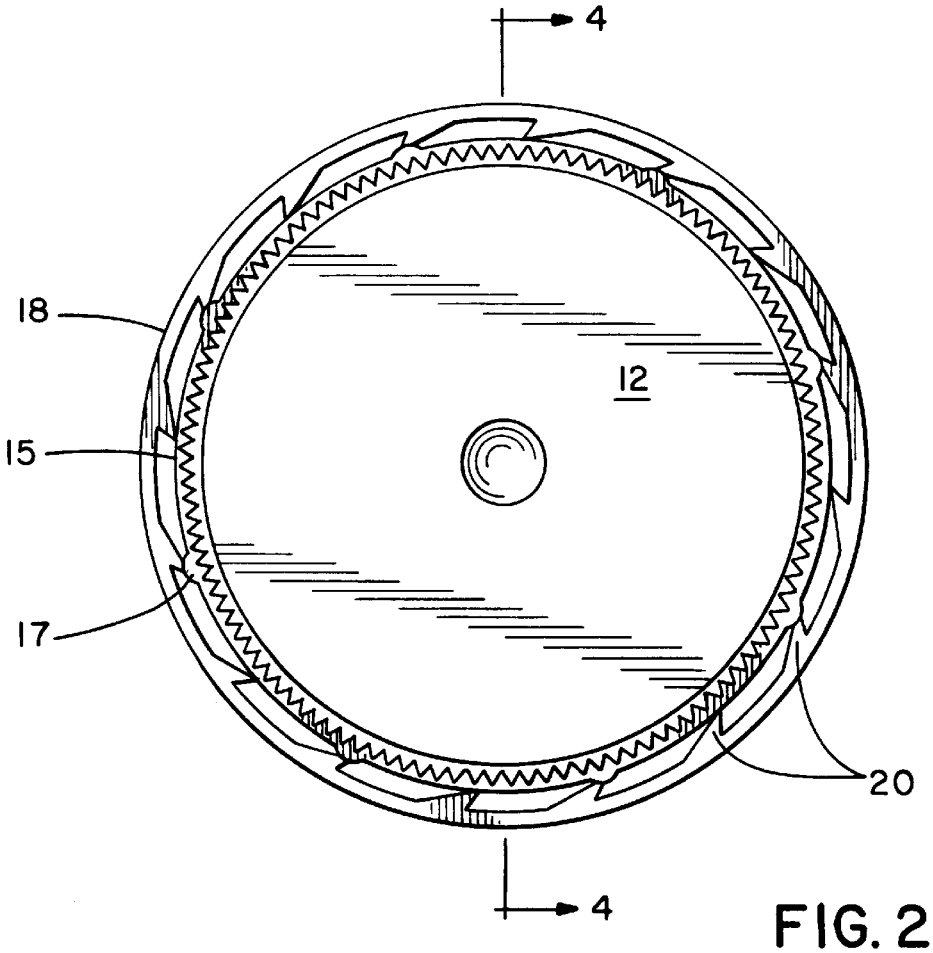
FIG. 2 is a top view of a bottle cap made in accordance with the present invention.

FIGS. 1 and 2 generally depict the outside of a bottle cap 11. The cap 11 is comprised of a circular cover 12 and a depending skirt 14 with knurls 15 formed on the outside surface thereof. A flange 16 is formed at the bottom of the skirt. The flange 16 includes a plurality of semi-circular outwardly directed tabs 17 which are equally spaced around the flange 16. A ratchet ring 18 including a plurality of ratchet teeth 20 is frangibly connected to the tabs 17 of the flange 16 by way of connections between each tab 17 and every other tooth 20 around the circumference of the flange 16. The ratchet ring 18 has a lower edge 21 and an outer edge 22 which meet in an outer lower corner 23 of the ratchet ring 18, as can be seen in FIG. 4.

Figure 3:
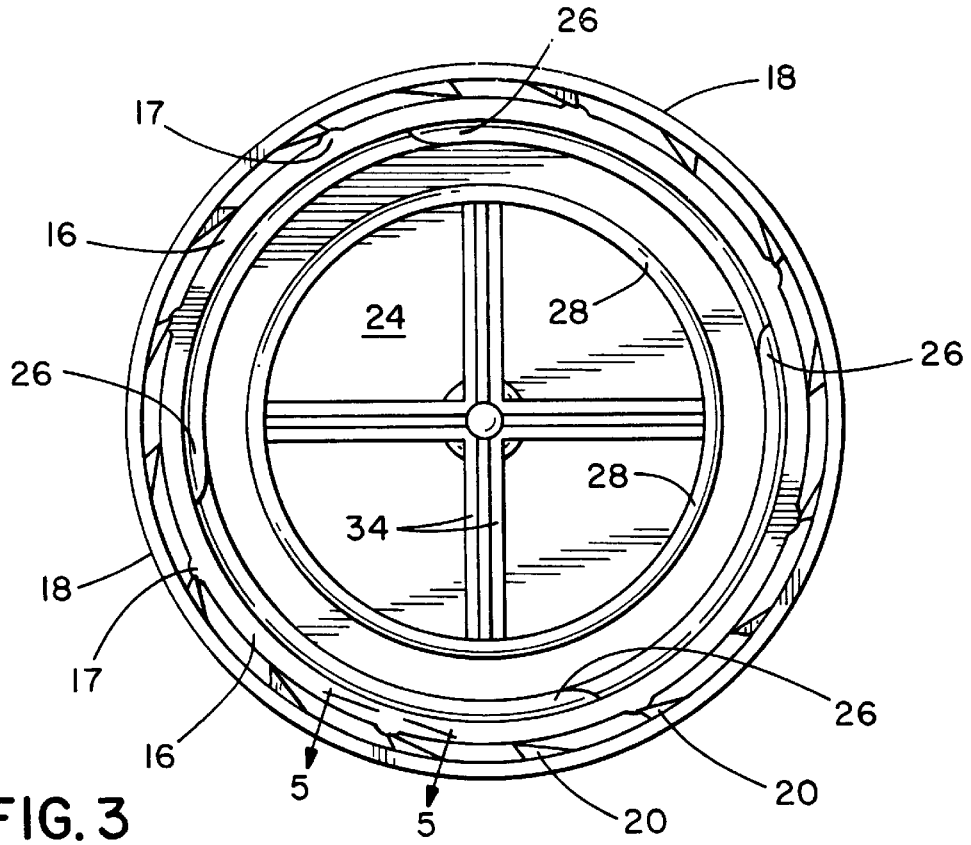
FIG. 3 is a bottom view of a bottle cap made in accordance with the present invention.

FIG. 3 shows the underside 24 of the cover 12. Four distinct threads 26 are formed on the inside surface of the skirt 14. A sealing plug 28 is also formed on the underside 24 of the cover 12.

Bottle caps generally, and threaded caps in particular, tend to shrink most where there is substantial differential in volume of plastic material. Bottle caps which are injection molded tend to shrink in such a way as to deform an initially flat cover 12 into a dome-shaped surface. Significant volume of material is required to form threads which are sufficiently strong to hold the cap 11 in place. The cover 12, on the other hand, needs only to have sufficient thickness to withstand puncturing forces. The shrinkage of the cap 11 to form a dome ("doming") creates problems as it relates to dimensional stability and sealing effectiveness, and sometimes causes problems relating to the affixing of a label on the top of the cover 12. For example, radially inward shrinkage will tend to reduce the outside diameter of the plug 28. To reduce the effects of such shrinkage, the cap 11 has means for limiting the doming of the cover 12. Four pairs of radial ribs 34 extend from the center of the underside 24 of the cover 12 to the plug 28. The radial ribs 34 provide the cover 12 with structural integrity sufficient to withstand the tendency for the cover 12 to assume a domed shape. In addition, by providing the cover 12 with additional volume of plastic material, the differential in material volume between the cover and the skirt is reduced, which tends to further reduce the distorting effects of shrinkage.

Figure 4:
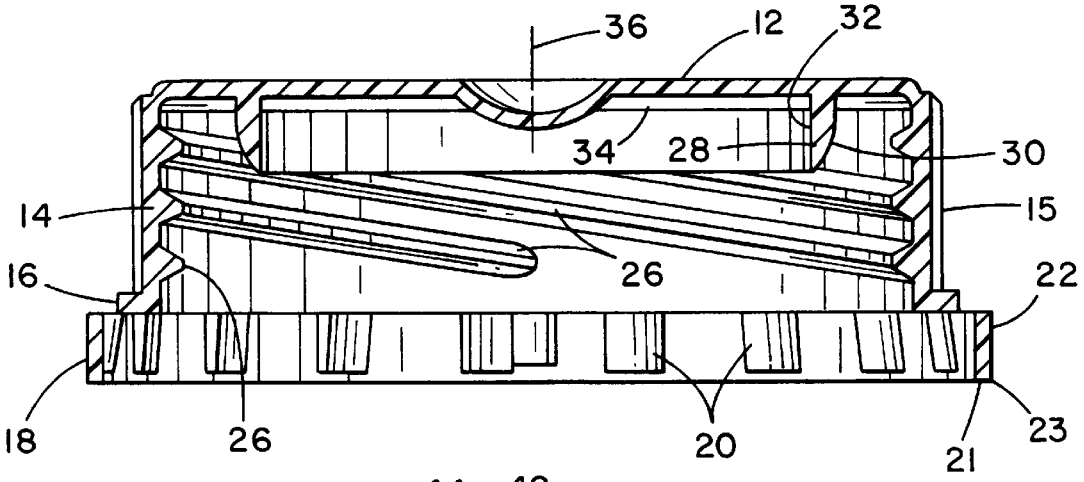
FIG. 4 is a cross-sectional view taken along line 4—4 of FIG. 2.

FIG. 4 more clearly shows the location and configuration of the plug 28. The plug 28 is a generally circumferentially continuous formation integrally connected to the underside 24 of the cover 12. The plug 28 is disposed about the central axis 36 of the cap 11. The plug 28 has an outer surface 30 which is generally parabolic about the axis 36 and an inner surface 32 substantially parallel to the axis 36. It is important in order to achieve proper sealing that the surfaces which comprise the plug 28 be concentric about the central axis of the cap 11.

In an alternative embodiment of the present invention, the underside 24 of cover 12 does not include the plug 28 and the four pairs of radial ribs 34. The absence of a plug and radial ribs means that the cap could be used with a foil liner having a heat sensitive surface which can be heated into sealing engagement with the upper surface of a bottle neck by induction heating.

Figure 5:
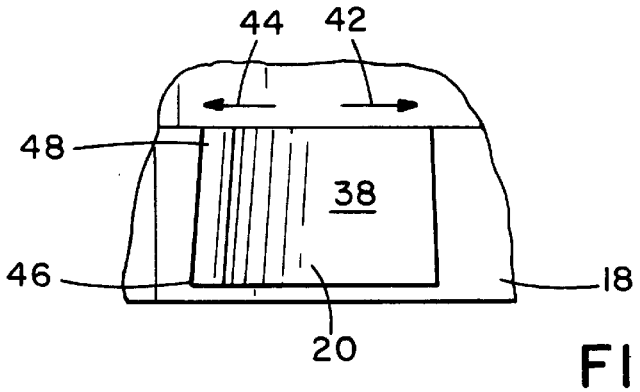
FIG. 5 is an enlarged view taken along line 5—5 of FIG. 3.
Figure 6A:
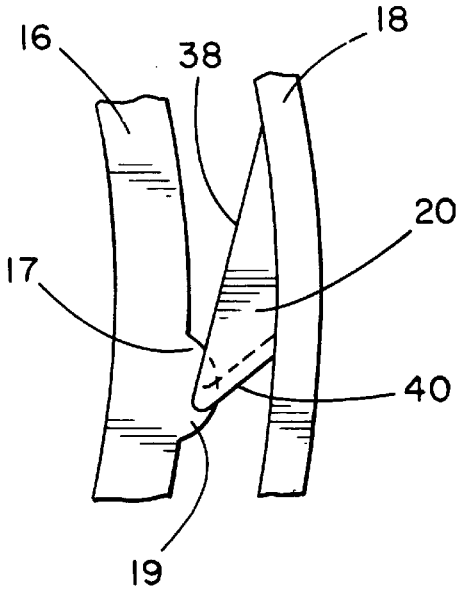
FIG. 6A is an enlarged bottom view of the tooth shown in FIG. 5.
Figure 6B:
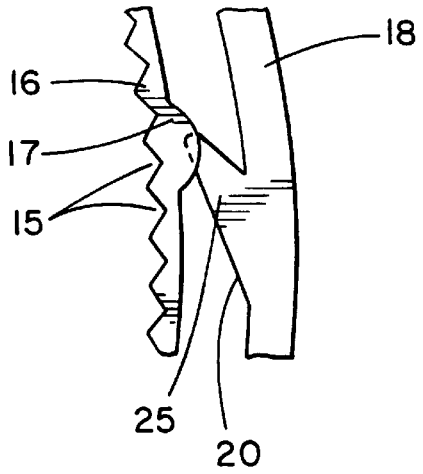
FIG. 6B is an enlarged top view of the tooth shown in FIG. 5.

FIGS. 5, 6A and 6B more clearly show the configuration of the ratchet teeth 20 and the semi-circular outwardly directed tabs 17 of the flange 16. Each tooth 20 is comprised of a ramp surface 38 and an abutting surface 40. Arrow 42 indicates the direction in which the cap 11 moves when the cap 11 is installed or tightened. Arrow 44 indicates the direction required to unscrew the cap 11. The abutting surface 40 of the tooth 20 is sloped in such a way that the lower edge 46 of the tooth 20 is offset with respect to the upper portion 48 of the tooth 20 in the direction (Arrow 44)

of unscrewing the cap 11. As a result, as the tooth 20 engages a mating ratchet tooth on a bottle neck, the lower edge 46 of the tooth 20 will engage the mating ratchet tooth first. The sloping nature of the abutting surface 40 will enhance the engagement of the tooth 20, and will resist unintended camming or slippage of the teeth 20 on the cap 11 relative to the matching ratchet teeth on the bottle neck. Thus, when cap 11 is turned in direction 42, the ratchet teeth 20 of the cap will ride over the mating ratchet teeth on the bottle neck, and when the cap is turned in direction 44, the ratchet teeth 20 of the cap 11 will positively engage the mating ratchet teeth of the bottle neck.

FIG. 6A, which is a bottom view of the tooth 20 shown in FIG. 5, and FIG. 6B, which is a top view of the tooth 20 shown in FIG. 5, also show the attachment of the ratchet teeth 20 to the semi-circular outwardly directed tabs 17 of the flange 16. Each of the ratchet teeth 20 includes an upper surface 25 which is generally coplanar with the cover 12 of the cap 11. Each of the semi-circular outwardly directed tabs 17 of the flange 16 includes a lower surface 19 which is also generally coplanar with the cover 12 of the cap 11. The lower surface 19 of each tab 17 has an area substantially in the shape of a semicircle.

Tabs 17 are shown as having the same vertical extent as the flange 16. However, the tabs may have a height which is less than the height of the flange 16.

The tabs 17 and the ratchet teeth 20 are attached by way of a frangible connection between the lower surface 19 of each tab 17 and the upper surface 25 of each of the ratchet teeth 20. It can be seen from FIG. 6A and 6B that the cross-sectional area of the frangible connection between a tab 17 and one of the ratchet teeth 20 is defined by the area wherein the lower surface 19 of each tab 17 and the upper surface 25 of each of the ratchet teeth 20 overlap. It can be appreciated that by varying the area of overlap between the lower surface 19 of each tab 17 and the upper surface 25 of each of the ratchet teeth 20, the strength of the frangible connection between the tabs 17 and the ratchet teeth 20 can be adjusted, as a frangible connection having a greater cross-sectional area will require a greater force in order to fracture the connection.

The adjustment of the area of overlap between the lower surface 19 of the tabs 17 and the upper surface 25 of the ratchet teeth 20 can be made using an injection molding die having portions which are movable with respect to each other. Namely, an injection molding die can be constructed wherein a first element of the die which molds the tabs 17 and a second element of the die which molds the ratchet teeth 20 are rotatable in relation to each other. When a bottle cap having stronger connections between the tabs 17 and the teeth 20 of the ratchet ring 18 is desired, the first and second element of the die are rotated so that the area of overlap between the lower surface 19 of each of the tabs 17 and the upper surface 25 of each of the ratchet teeth 20 is increased. In a similar manner, the strength of the connection between the tabs 17 and the teeth 20 of the ratchet ring 18 can be decreased by decreasing the area of overlap between the lower surface 19 of each of the tabs 17 and the upper surface 25 of each of the ratchet teeth 20. Therefore, the use of tabs 17 connected to ratchet teeth 20 as a means for attaching the ratchet ring 18 to the skirt 14 of the cap 11 provides for a bottle cap design wherein the torque required to fracture the frangible connection between the skirt 14 and ratchet ring 18 can be precisely controlled. In addition, the means for attaching the ratchet ring 18 to the skirt 14 provides for a bottle cap design that limits the ability of a person to pull the lower edge 21 of the ratchet ring 18 outward and then upward toward the cover 12 of the cap 11 as the strong connections between the tabs 17 and ratchet teeth 20 resist twisting of the ratchet ring outward and upward.

The need to adjust the strength of the connection between the ratchet ring and the skirt may arise from a change in the material used to form the cap. Some caps, for example, will require more of an overlap (i.e., more cross-section area connecting) between the rachet tooth and the bottom surface of the flange 16, than will other. Thus, if a customer's application calls for a cap made of a material different from the material used to make a previous cap, the same tooling may be used and the change of materials may be accounted for by a simple relative rotation of the molds. Moving the mold for the ratchet ring relative to the molding for the body of the cap will cause an inward (or decrease) in the cross-sectional area of connecting material between the teeth and the tabs extending from the flange. Specifically, for example, moving the molds in a way which causes the ring 18 (in FIG. 6A) to be formed in a position upwardly (as shown in FIG. 6A) will reduce the area of connection.

In contrast, the attachment of the ratchet ring to the skirt in prior bottle cap designs is often accomplished by way of a number of thin stretchable strips of material which are connected to a bottom edge of the skirt and to an inner side surface of the ratchet teeth or an inner side surface of the ratchet ring. The ability to vary the strength of the thin connecting strips in these designs is quite limited as the area of overlap between the connecting strip and the skirt or ratchet ring cannot be easily varied. Furthermore, the thin strips of material connecting the skirt and ratchet ring are often weak and cannot resist twisting of the lower edge of the ratchet ring outward and then upward toward the cover of the cap.

Figure 7:
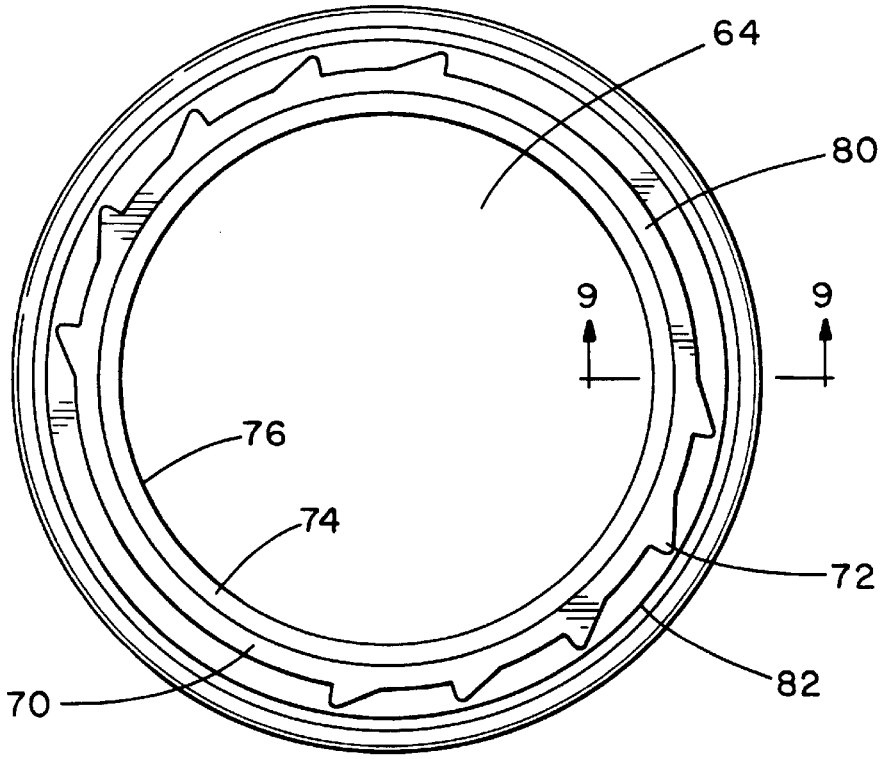
FIG. 7 is a top view of a bottle neck made in accordance with the present invention.
Figure 8:
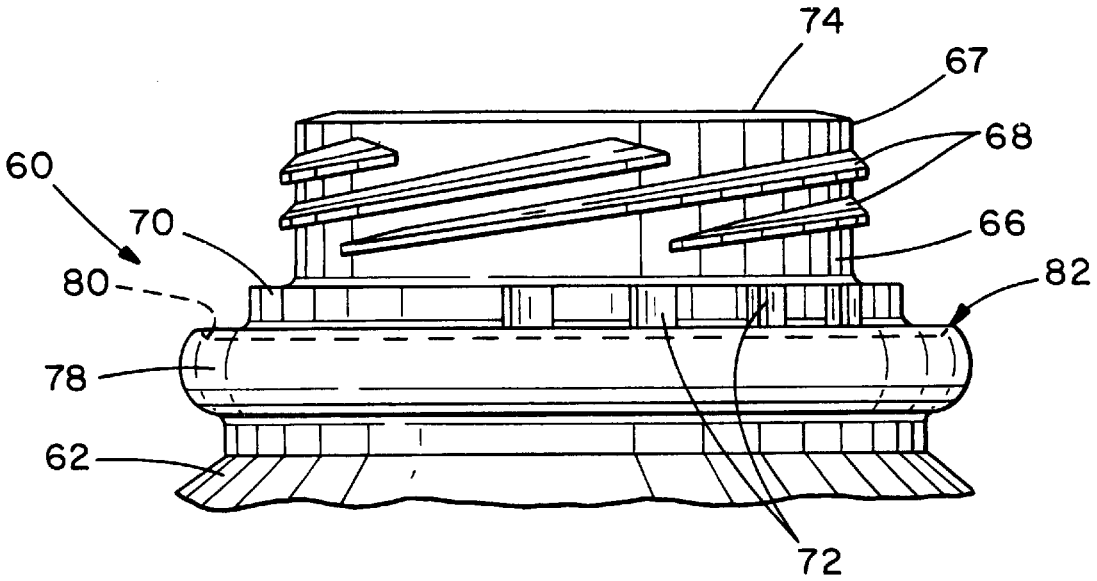
FIG. 8 is a side view of a bottle neck made in accordance with the present invention.
Figure 9:
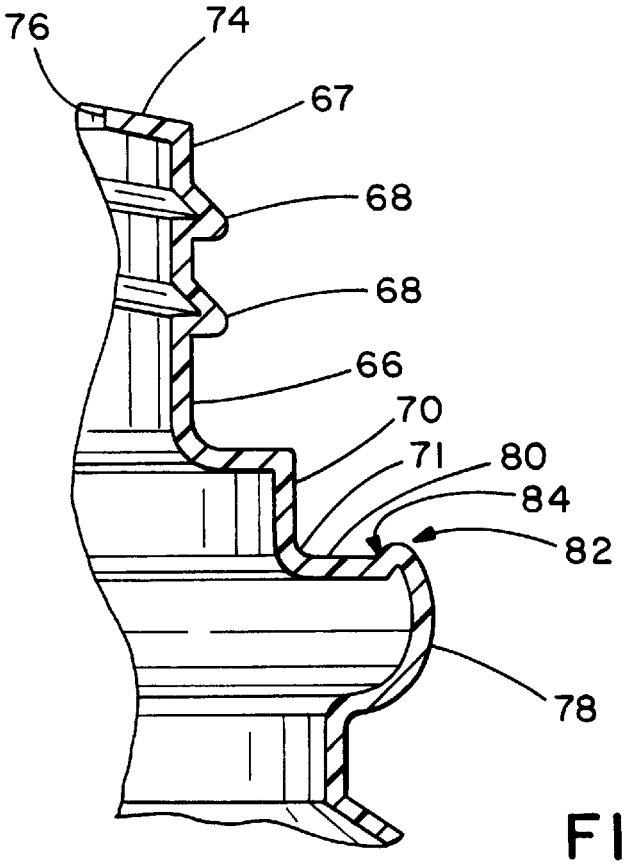
FIG. 9 is a cross-sectional view taken along line 9—9 of FIG. 7.

Referring now to FIGS. 7, 8 and 9 there is shown a bottle, indicated generally at 60, upon which the bottle cap 11 of the present invention may be installed. The bottle 60 includes a body 62 and a cylindrical bottle neck 66 which is integral with the body 62. The bottle neck 66 has an upper opening 64 and an upper end 67 which terminates in an inwardly directed circumferential sealing lip 74 with an inner edge 76. The bottle neck 66 also includes four external screw threads 68 which engage threads 26 of bottle cap 11.

The bottle neck 66 further includes a circumferential ratchet portion 70 having ratchet teeth 72. The ratchet teeth 72 engage the ratchet teeth 20 of the ratchet ring 18 of the bottle cap 11 when the bottle cap 11 is installed on the bottle neck 66. In the preferred embodiment shown in FIG. 7, the ratchet teeth 72 are not arranged around the entire circumference of the ratchet portion 70, but are arranged in two groups, each of the two groups occupying an arc covering about one quarter of the circumference of the ratchet portion 70. It can be seen that the groups of ratchet teeth 72 are arranged on diametrically opposite sides of the bottle neck 66.

The bottle neck 66 also includes a circumferential "bumper roll" or transfer ring 78 located below the ratchet portion 70. In prior bottle neck designs, a bumper roll has been provided on a bottle neck for manufacturing purposes as it facilitates gripping the bottle during the filling operation and grabbing the bottle during the loading of the bottle into a shipping container. However, the bumper roll 78 of the bottle neck 66 of the present invention includes additional features which provide even further advantages.

It can be seen from FIGS. 7, 8 and 9 that bumper roll 78 includes a substantially flat annular top surface 80 which has an upwardly extending circumferential ridge 82 along the entire length of its periphery. Preferably, the top surface 80 of the bumper roll 78 is substantially parallel with respect to a plane defined by the opening 64 of the bottle neck 66. Also, it is preferred that the top surface 80 of the bumper roll 78 is joined to a lower end 71 of the ratchet portion 70 and that the uppermost point of the ridge 82 of the bumper roll 78 is above the lower end 71 of the ratchet portion 70. The placement of a ridge 82 on the periphery of the top surface 80 of the bumper roll 78 serves to increase the resistance of the bottle neck 66 and bottle cap 11 to unwanted removal of the cap by an individual seeking to tamper with the contents of the bottle. Specifically, when bottle cap 11 is fully threaded onto bottle neck 66, the lower edge 21 of ratchet ring 18 is placed in contact with or closely adjacent to the top surface 80 of bumper roll 78, and the outer edge 22 of the ratchet ring 18 is placed adjacent to the inner surface 84 of ridge 82. In this arrangement of the ratchet ring 18 of the bottle cap 11 and the bumper roll 78 of bottle neck 66, the ridge 82 of the bumper roll 78 completely surrounds the lower portion of the ratchet ring 18 so that it is very difficult to insert a thin object, such as a fingernail, under the outer lower corner 23 of the ratchet ring 18. Therefore, the ridge 82 of the bumper roll 78 improves the tamper resistance of the bottle as it is extremely difficult to insert an object under the ratchet ring 18 and pry the ratchet ring 18 away from the bottle neck 66 in an effort to defeat the locking action of the ratchet teeth 20 of the ratchet ring 18 and the ratchet teeth 72 of the bottle neck 66.

Thus, it is seen that an improved tamper resistant bottle cap and neck are provided which satisfy the need for a bottle with an improved tamper resistant seal. The present invention includes a bottle cap with an improved means for connecting a tamper evidencing ring to the cap which limits the ability of a person to defeat the locking action of ratchet teeth on the tamper evidencing ring and bottle neck. The present invention also includes a bottle neck with an improved transfer ring which makes it difficult to insert an object under the ratchet ring and pry the ratchet ring away from the bottle neck.

Although the present invention has been described in considerable detail with reference to certain preferred embodiments, one skilled in the art will appreciate that the present invention can be practiced by other than the preferred embodiments, which have been presented for purposes of illustration and not of limitation. Therefore, the spirit and scope of the appended claims should not be limited to the description of the preferred embodiments contained herein.

What is claimed is:

1. In combination, a tamper resistant bottle cap and bottle neck, the bottle neck comprising an opening at an upper end of the neck, a cylindrical exterior surface having a first engagement means, a circumferential ratchet portion disposed below the first engagement means, the ratchet portion having a plurality of ratchet teeth, and a circumferential transfer ring disposed below the ratchet portion, the transfer ring including an annular top surface; and the bottle cap comprising a circular cover, a skirt depending from the periphery of the cover, the skirt including an interior surface having a second engagement means and a lower end having a circumferential flange, the flange including outwardly extending tabs, and a tamper evidencing ring including a lower edge and a plurality of ratchet teeth which are capable of meshing with the ratchet teeth on the ratchet portion of the bottle neck when the bottle cap is screwed onto the bottle neck, the tamper evidencing ring being connected to the flange by frangible connections between the outwardly extending tabs of the flange and the ratchet teeth of the tamper evidencing ring, the first engagement means and the second engagement means being dimensioned so as to sealingly engage when the bottle cap is screwed onto the bottle neck, the lower edge of the tamper evidencing ring being adjacent the top surface of the transfer ring when the bottle cap is screwed onto the bottle neck, and the ratchet teeth of the bottle neck and the ratchet teeth of the bottle cap being shaped so as to prevent unscrewing of the bottle cap relative to the bottle neck without breaking the frangible connections.

2. The combination of claim 1 wherein the transfer ring of the bottle neck further comprises an upwardly extending circumferential ridge on the periphery of the annular top surface.

3. The combination of claim 2 wherein each of the frangible connections is defined by an area of overlap between a lower surface of each tab and an upper surface of each of the ratchet teeth of the tamper evidencing ring.

4. The combination of claim 3 wherein the top surface of the transfer ring of the bottle neck is joined to a lower end of the ratchet portion of the bottle neck and said transfer ring having an upper edge, said upper edge extending above the lower end of the ratchet portion of the bottle neck.

5. The combination of claim 4 wherein the tabs of the flange of the bottle cap are semi-circular and are equally spaced around the circumference of the flange.

6. The combination of claim 5 which further comprises:

an inwardly directed circumferential sealing lip at the opening of the bottle neck; and a plug extending downwardly from the underside of the cover of the bottle cap, the plug being a circumferentially continuous formation having a tapered outer surface disposed about a central axis of the cap, the outer surface of the plug being tapered to increase in diameter upwardly, the outer surface of the plug being for sealingly engaging the sealing lip of the bottle neck when the bottle cap is screwed on the bottle neck.

7. The combination of claim 6 wherein the first engagement means and the second engagement means comprise threads.

8. The combination of claim 7 which further comprises:

surface grasping means disposed on an outside surface of the skirt of the bottle cap.

9. The combination of claim 8 wherein the underside of the cover of the bottle cap further includes radial ribs extending from a central portion of the underside of the cover to the plug.

10. In combination, a tamper resistant bottle cap and bottle neck, the bottle neck comprising an opening at an upper end of the neck, a cylindrical exterior surface having a first engagement means, a circumferential ratchet portion disposed below the first engagement means, the ratchet portion having a plurality of ratchet teeth, and a circumferential transfer ring disposed below the ratchet portion, the transfer ring including an annular top surface and an upwardly extending circumferential ridge on the periphery of the annular top surface; and the bottle cap comprising a circular cover, a skirt depending from the periphery of the cover, the skirt including an interior surface having a second engagement means and a lower end having a circumferential flange, and a tamper evidencing ring including a lower edge and a plurality of ratchet teeth which are capable of meshing with the ratchet teeth on the ratchet portion of the bottle neck when the bottle cap is screwed onto the bottle neck, the tamper evidencing ring being connected to the flange by frangible connections, the first engagement means and the second engagement means being dimensioned so as to sealingly engage when the bottle cap is screwed onto the bottle neck, the lower edge of the tamper evidencing ring being adjacent the top surface of the transfer ring when the bottle cap is screwed onto the bottle neck, and the ratchet teeth of the bottle neck and the ratchet teeth of the bottle cap being shaped so as to prevent unscrewing of the bottle cap relative to the bottle neck without breaking the frangible connections, the flange of the bottle cap including outwardly extending tabs, and the tamper evidencing ring of the bottle cap being connected to the flange of the bottle cap by said frangible connections between the outwardly extending tabs of the flange and the ratchet teeth of the tamper evidencing ring.

11. The combination of claim 10 wherein each of the frangible connections is defined by an area of overlap between a lower surface of each tab and an upper surface of each of the ratchet teeth of the tamper evidencing ring.

12. The combination of claim 11 wherein the top surface of the transfer ring of the bottle neck is joined to a lower end of the ratchet portion of the bottle neck.

13. The combination of claim 12 wherein said transfer ring has an upper edge, said upper edge extending above the lower end of the ratchet portion of the bottle neck.

14. The combination of claim 13 wherein the tabs of the flange of the bottle cap are semi-circular and are equally spaced around the circumference of the flange.

15. The combination of claim 14 which further comprises:

an inwardly directed circumferential sealing lip at the opening of the bottle neck; and a plug extending downwardly from the underside of the cover of the bottle cap, the plug being a circumferentially continuous formation having a tapered outer surface disposed about a central axis of the cap, the outer surface of the plug being tapered to increase in diameter upwardly, the outer surface of the plug being for sealingly engaging the sealing lip of the bottle neck when the bottle cap is screwed on the bottle neck.

16. The combination of claim 15 wherein the first engagement means and the second engagement means comprise threads.

17. The combination of claim 16 which further comprises:

surface grasping means disposed on an outside surface of the skirt of the bottle cap.

18. The combination of claim 17 wherein the underside of the cover of the bottle cap further includes radial ribs extending from a central portion of the underside of the cover to the plug.

19. A tamper resistant bottle cap comprising:

a circular cover;

a skirt depending from the periphery of the cover, the skirt including an interior surface having means for retaining the cap to a bottle neck and a lower end having a circumferential flange, the flange including outwardly extending tabs; and a tamper evidencing ring including a plurality of ratchet teeth which are capable of meshing with a matching set of ratchet teeth on the bottle neck, the ring being connected to the flange by frangible connections between the outwardly extending tabs of the flange and the ratchet teeth of the ring.

20. The tamper resistant bottle cap of claim 19 wherein each of the frangible connections is defined by an area of overlap between a lower surface of each tab and an upper surface of each of the ratchet teeth of the ring.

21. The tamper resistant bottle cap of claim 20 wherein the torque required to be exerted on the cap to fracture the frangible connections can be adjusted by varying the area of overlap between the lower surface of each tab and the upper surface of each of the ratchet teeth of the ring.

22. The tamper resistant bottle cap of claim 21 wherein the tabs of the flange are semi-circular and are equally spaced around the circumference of the flange.

23. The tamper resistant bottle cap of claim 22 wherein the means for retaining the cap to a bottle neck comprise threads.

24. The tamper resistant bottle cap of claim 23 further comprising:

surface grasping means disposed on an outside surface of the skirt.

25. The tamper resistant bottle cap of claim 24 wherein the surface grasping means comprise a series of vertical, closely spaced ribs forming knurling.

26. The tamper resistant bottle cap of claim 25 further comprising:

a plug extending downwardly from the underside of the cover, the plug being a circumferentially continuous formation having a tapered outer surface disposed about a central axis of the cap, the outer surface of the plug being tapered to increase in diameter upwardly, the outer surface of the plug being for sealingly engaging an inwardly extending flange of the bottle neck.

27. The tamper resistant bottle cap of claim 26 wherein the underside of the cover includes radial ribs extending from a central portion of the underside of the cover to the plug.

28. The tamper resistant bottle cap of claim 27 wherein at least one of the rachet teeth of the tamper evidencing ring has first and second tooth surfaces, the first tooth surface forming a ramp to facilitate placement of the bottle cap on the bottle neck without breaking the frangible connections, the second tooth surface forming an abutment, the second tooth surface sloping over a substantial portion of its length with respect to a plane defined by an open end of the skirt, such that portions of the second tooth surface nearer the open end of the skirt are offset with respect to portions nearer the cover.

29. A blow molded bottle neck comprising:

an opening at an upper end of the neck;

a cylindrical exterior surface having threads for retaining a cap, outer portions of said said thread defining a first diameter;

a circumferential ratchet portion disposed below the means for retaining a cap, the ratchet portion having a plurality of ratchet teeth which are capable of meshing with a matching set of ratchet teeth on the cap; and a circumferential ring having a second diameter disposed below the ratchet portion, said second diameter being greater than said first diameter, the ring including an annular top surface and an upwardly extending circumferential ridge on the periphery of the annular top surface; said ridge being formed by a thin wall having a hollow interior.

30. The bottle neck of claim 29 further comprising:

an inwardly directed circumferential sealing lip at the opening of the bottle neck.

31. The bottle neck of claim 29 wherein the top surface of the ring is joined to a lower end of the ratchet portion.

32. The bottle neck of claim 31 wherein said circumferential ring has an upper edge, said upper edge extending above the lower end of the ratchet portion.

33. The bottle neck of claim 32 wherein the top surface of the ring is substantially parallel with respect to a plane defined by the opening of the bottle neck.

34. The bottle neck of claim 33 wherein the ratchet teeth of the neck are disposed in two groups, each of the groups occupying an arc covering about one quarter of the circumference of the ratchet portion.

35. The bottle neck of claim 34 wherein the two groups of ratchet teeth are arranged on opposite sides of the ratchet portion.

* * * * *